US007192215B2

(12) United States Patent
Manor

(10) Patent No.: US 7,192,215 B2
(45) Date of Patent: Mar. 20, 2007

(54) APPARATUS AND METHOD FOR ERASING ROAD LANE MARKINGS

(76) Inventor: Zamir Manor, Hapsanter 11/18, Rishon Le-Zion (IL) 75583

( * ) Notice: Subject to any disclaimer, the term of this patent is extended or adjusted under 35 U.S.C. 154(b) by 0 days.

(21) Appl. No.: 10/525,065

(22) PCT Filed: Aug. 20, 2003

(86) PCT No.: PCT/IL03/00690

§ 371 (c)(1),
(2), (4) Date: Feb. 18, 2005

(87) PCT Pub. No.: WO2004/018775

PCT Pub. Date: Mar. 4, 2004

(65) Prior Publication Data

US 2006/0165487 A1 Jul. 27, 2006

(30) Foreign Application Priority Data

Aug. 20, 2002 (IL) ..... 151353

(51) Int. Cl.
*E01C 7/06* (2006.01)

(52) U.S. Cl. ..... 404/77; 404/79; 404/94; 15/106

(58) Field of Classification Search ..... 15/52, 15/106, 211, 213; 404/96, 94, 77, 79
See application file for complete search history.

(56) References Cited

U.S. PATENT DOCUMENTS 2,588,039 A * 3/1952 Pepi ..... 37/228
2,987,741 A * 6/1961 Feldman et al. ..... 15/4
3,013,552 A 12/1961 West
4,172,679 A * 10/1979 Wirtgen ..... 404/90
4,601,605 A * 7/1986 Damp et al. ..... 404/95
5,382,084 A 1/1995 Diver et al.
5,605,381 A * 2/1997 Schmoock, Jr. et al. ... 299/39.2
5,718,534 A * 2/1998 Neuling ..... 404/94
6,174,104 B1 1/2001 Fields

FOREIGN PATENT DOCUMENTS

DE 26 50 487 A 5/1978
DE 28 47 924 A 5/1980
DE 28 52 218 A 6/1980
DE 31 40 984 A 5/1983
EP 0 935 027 A 8/1999
JP 11-217810 * 8/1999

* cited by examiner

*Primary Examiner*—Gary S Hartmann
(74) *Attorney, Agent, or Firm*—Browdy and Neimark, PLLC

(57) ABSTRACT

An apparatus for erasing a road marking on a road lane comprising a chassis adapted to travel over the road lane; a heating source mounted to the chassis for directly or indirectly applying heat to the road marking; and a positively driven rotatable brush mounted to the chassis. The brush has bristles contactable with the road marking and adapted for removing it, when heated, from the road. Indirect heating of the road marking can be accomplished by first heating the bristles of the brush.

14 Claims, 4 Drawing Sheets

APPARATUS AND METHOD FOR ERASING ROAD LANE MARKINGS

FIELD OF THE INVENTION

The present invention relates to an apparatus and method for removing road markings such as lane lines, stripes, arrows and the like from roads.

BACKGROUND OF THE INVENTION

Road lane markings, such as lane lines, stripes, arrows and the like are commonly applied to road lanes for designating vehicular traffic flow.

Large efforts have been expended to improve the durability of these road markings in the face of intensive wear caused by vehicle tires and deterioration caused by the sun and weather. Hence, there have been a variety of marking substances (special paints, heated thermosetting or reactive thermoplastics, epoxy and other materials) developed and introduced.

Techniques have also been developed to increase the thickness of the applied paint layer composing the markings, so that it will be felt by drivers when passed over and to produce reflecting effects to increase the ease and safety of night-time driving.

Occasionally there exists the need to erase existing road markings. This may occur when the road undergoes maintenance operations, changes such as the addition of a lane or lanes, temporary deviations or detours, or other circumstances requiring the erasure of road markings.

A typical method to eliminate the markings is simply to cover them with a layer of pitch. However, this cover material can prove to be reflective when illuminated by vehicle headlights, which of course is confusing and uncomfortable for the driver and may cause a traffic safety problem. If the markings are chipped off (e.g. with chisels or by sand blasting), the result will be the formation of cavities or depressions that may endanger driving and damage vehicles.

SUMMARY OF THE INVENTION

The present invention relates to an apparatus and method for removing road markings such as lane lines, stripes, arrows and the like (hereinafter in the specification and claims, "road markings"), from roads the apparatus comprising a chassis adapted to travel over the road lane; a heating source mounted to the chassis for directly or indirectly applying heat to the road marking; and a positively driven rotatable brush mounted to the chassis. The brush has bristles contactable with the road marking and adapted for removing the road marking, when heated, from the road.

The method for removing road markings from roads comprises:

- providing an apparatus comprising a chassis with a heating source and a rotatable brush mounted thereto, the brush having bristles;
- bringing the apparatus to the road lane;
- causing the chassis to travel over the road lane;
- applying heat directly or indirectly to the road marking; and
- causing the bristles of the brush to rotate and contact the road marking thereby removing the marking.

The chassis is typically adapted for mounting or attaching to the front of a truck or other suitable vehicle. Mounting to the front of the truck aids visibility of the markings to be removed, however, the apparatus can be designed for rear mounting or even mounting such that at least the bulk of the apparatus is disposed to the side of the truck.

It is preferable that the apparatus comprises a means to displace the chassis, or at least, the brush, in a direction transverse to the truck, to facilitate alignment of the brush with the markings. Alternatively, the apparatus may be designed in a simpler manner wherein it does not include such means to displace the brush or chassis and the appropriate alignment of the brush with the markings is obtained by appropriately positioning the truck controls.

BRIEF DESCRIPTION OF THE DRAWINGS

These and additional constructional features and advantages of the invention will become more clearly understood in the light of the ensuing descriptions of embodiments thereof, given by way of example only with reference to the accompanying drawings, wherein.

DETAILED DESCRIPTION OF THE PREFERRED EMBODIMENT

Figure 1:
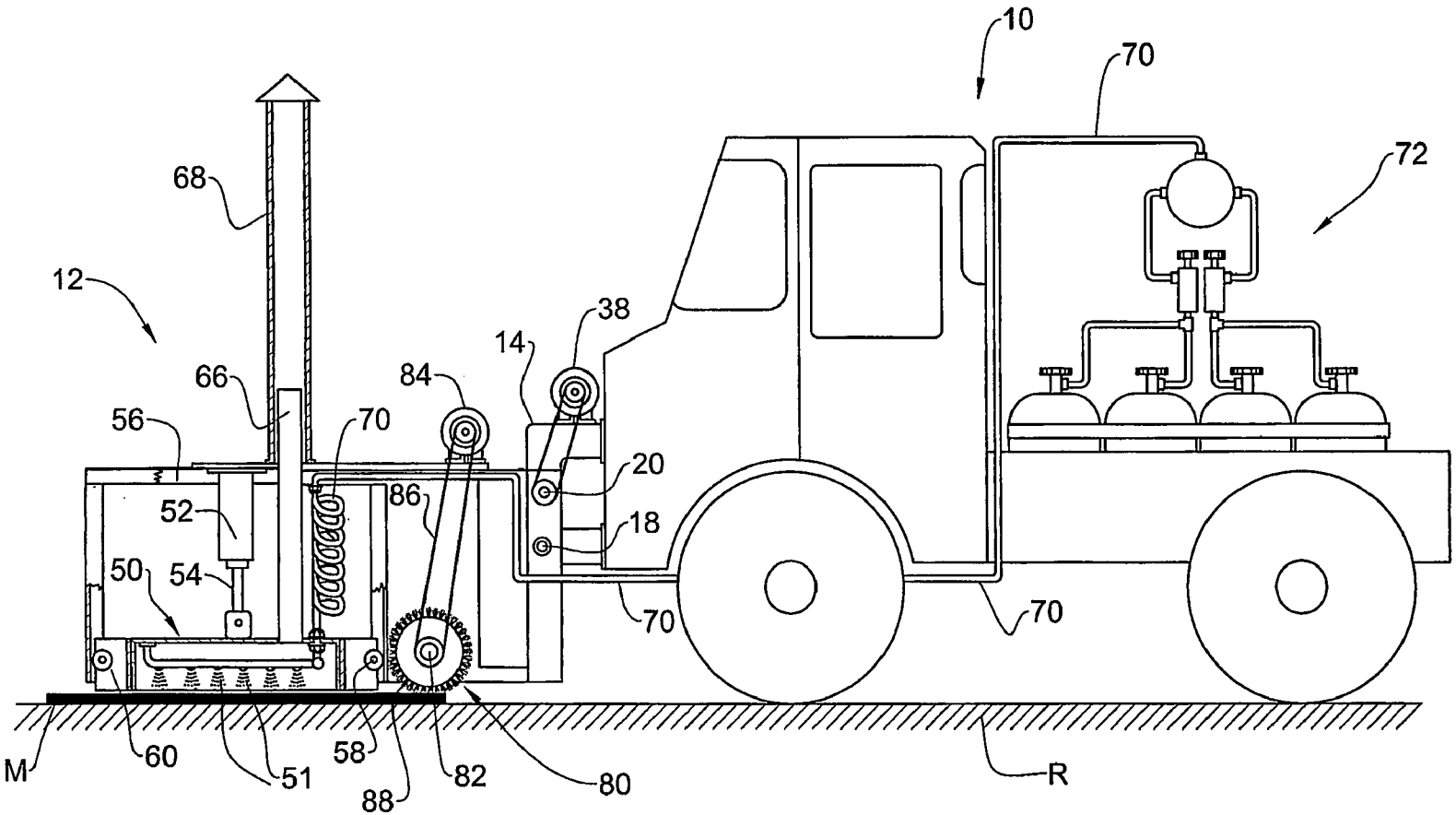
FIG. 1 is a schematic side view of an apparatus and associated vehicle for removing road markings according to the present invention.
Figure 2:
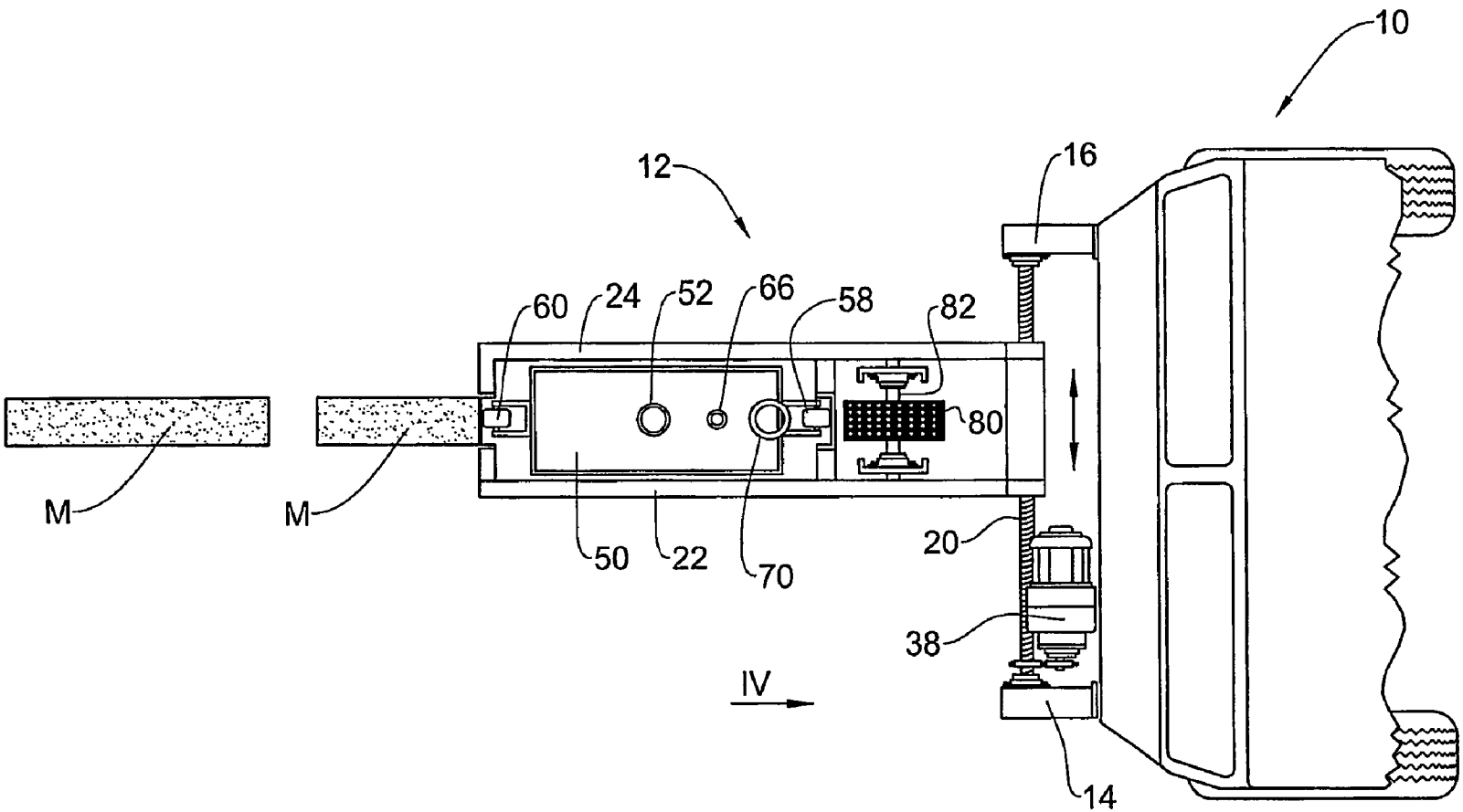
FIG. 2 is a top view of the apparatus in FIG. 1.

Schematically shown in FIGS. 1 and 2 is a vehicle 10, generally of any conventional type, e.g. a small truck, the vehicle adapted however to allow the attachment (e.g. mounting, connecting) thereto of an apparatus 12 designed for removing or erasing road markings M from a road R. The apparatus 12 is shown mounted to the front of the vehicle 10 by a pair of brackets 14 and 16.

Figure 4:
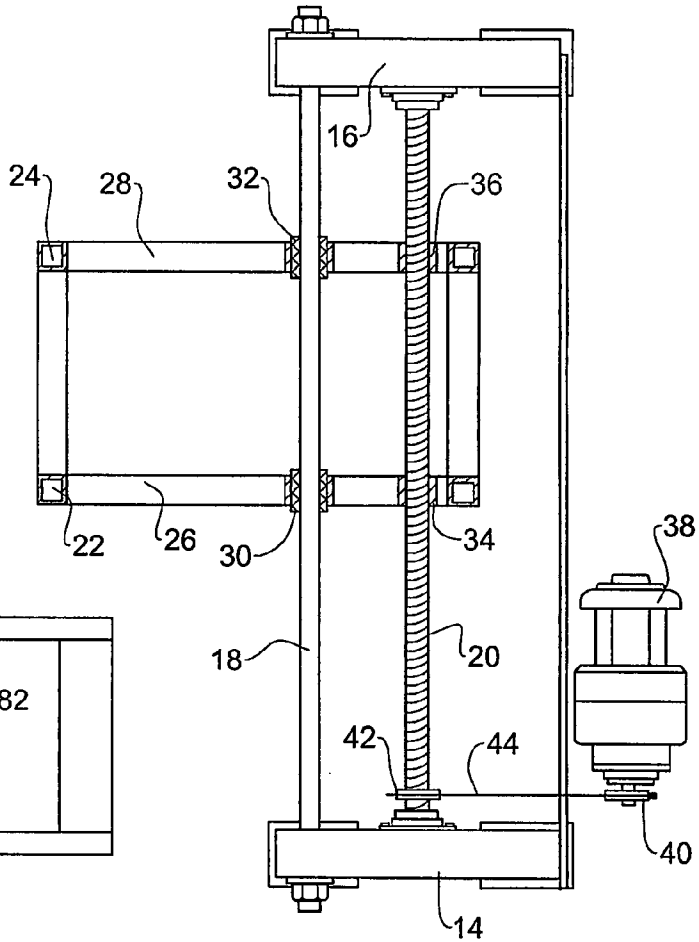
FIG. 4 is a view in the direction of arrow IV in FIG. 2, on an enlarged scale.

The apparatus 12, as a whole, is mounted to the brackets 14 and 16 by both a cross shaft 18 and a screw-threaded spindle 20, best seen in FIG. 4, extending parallel to each other. The apparatus 12 is thus suspended above the road R, in cantilever fashion, carried by horizontal chassis side rails 22, 24 rigidly connected to vertical rails 26 and 28 (FIG. 4). Rails 26 and 28 are coupled to the shaft 18 by slide bearings 30 and 32 and to the spindle 20 by nuts 34 and 36, respectively.

Alternatively, the apparatus 12 could be adapted to be at least partially supported above the road R by means other than, or in coordination with, the cantilever type arrangement detailed herein above. One such means is the use of any number of wheels (not shown) to allow the apparatus 12 to ride over the road R. By one aspect of this alternative, the weight of the apparatus 12 could be supported by these wheels in conjunction with the brackets 14 and 16 to support the apparatus. By another aspect, the weight of the apparatus 12 could be completely supported by wheels.

If the apparatus 12 were completely supported by wheels, the attaching arrangement need merely be a connecting mechanism to allow pushing (or pulling) thereof, and need not be a load bearing mechanism such as mounting.

Figure 3:
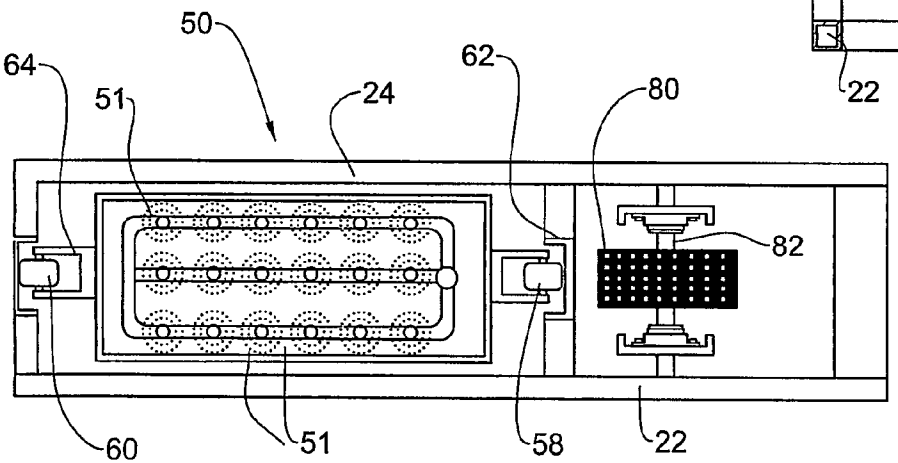
FIG. 3 is a bottom view of the apparatus of FIG. 1, on an enlarged scale.

With reference to FIGS. 1 and 3, the apparatus 12 is further provided with a heating source 50 such as a multi-flame burner unit having torches 51. The heating source 50 is suspended from above (although alternatively, it may be supported from below), and adjustably movable by an assembly comprising a pneumatic cylinder 52 and a piston 54 mounted to a top rail 56, guided by rollers 58, 60 along vertical rails 62, 64 respectively. A chimney fitting tube 66 extends upward into a chimney 68 to enable up and down movement of the heating source 50.

Alternatively the heating source could be, for example, an electric forced air heater (not shown) powerable by the vehicle's battery or another source of electricity.

As seen best in FIG. 4, the apparatus 12 can be transversely moved from side to side by rotation of the spindle 20 while maintaining an essentially constant height above the road R. The spindle 20 may be rotated in either or both directions by known means such as an electric drive motor 38 coupled thereto by sprocket wheels 40 and 42 via a sprocket chain 44.

A supply line 70, at least a portion of which is helically configured, is provided for flowing combustible gas or liquid (e.g. butane, propane, natural gas, kerosene etc.) from gas containers 72 carried by the vehicle 10 (FIG. 1). The helical configuration allows for movement of the heating source 50 and an analogous configuration (not seen) allows the transverse movement of the apparatus 12.

The apparatus 12 further comprises a high-speed rotatable brush 80, mounted on an axle 82 which is driven by a motor 84 via a belt 86—or other known means. The arrangement can be designed such that the brush 80, comprising bristles 88, can be rotated in either direction, however it is typically more effective for the brush to rotate in the direction opposite that of the progress of the vehicle 10.

The pressure of the brush 80 on the road markings M could be defined simply by the stiffness of the bristles 88 of the brush 80. To this end, the brush 80 could comprise bristles 88 of any combination of different length, thickness, stiffness and material (as long as the bristles reasonable withstand the heat and wear) to thereby optimize the pressure on the markings M and their removal.

However, to control and even out the pressure of the brush 80 on the road markings M, other means such as a spring (not shown) biased to press downward with a desired pressure or a weight (not shown) may be associated with the brush.

It should be understood that the bristles 88 of the brush 80 are configured in a pattern such that they contact the road markings M throughout the area of the markings, and to this end, groups of bristles may be shifted, offset, irregularly arranged, etc. For sake of clarity, this is not depicted in the figures.

The operation of the apparatus 12 for removing road markings M is as follows:

First, the truck 10 is driven to the location where erasure of road markings M is desired and it is positioned in alignment therewith. Due to the transverse displacement arrangement as explained above (using the spindle 20), it is not mandatory that the truck 10 itself be centered on the markings M, rather only the apparatus 12—and in actuality the brush 80—need be aligned with the road markings M. This feature allows removal/erasure of markings M adjacent the margins or shoulders of road lanes without driving with half the vehicle 10 off the road; and allows the removal of centrally located road markings without need to drive the vehicle in the center of the road R which would potentially block traffic.

Then, while the torches 51 are burning and the brush 80 is rotating, the vehicle 10 is slowly driven over the road markings M thereby removing them.

The heating of the road markings M by the torches 51 may be direct with the distance of the torches from the road markings being adjustable, as described above. The distance of the torches 51 from the road markings M can be used to adjust and optimize the heat applied to the markings.

Figure 6:
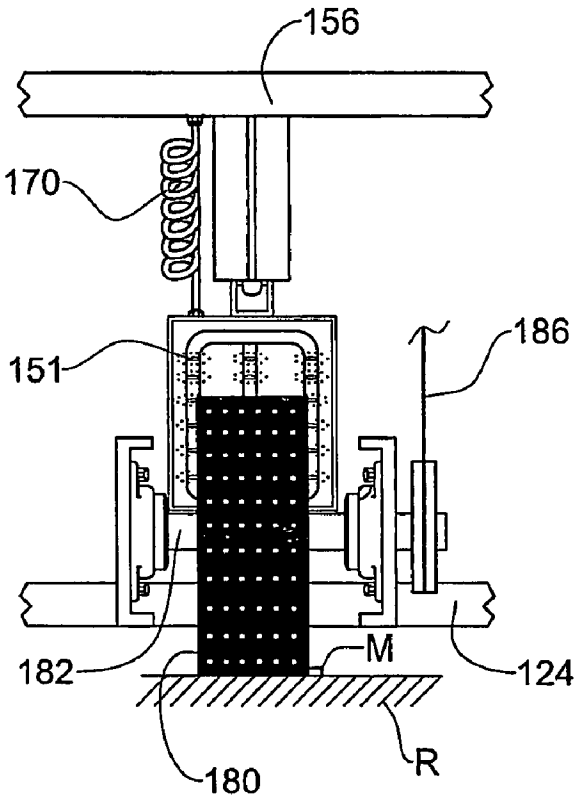
FIG. 6 is a view in the direction of arrow VI in FIG. 5.
Figure 5:
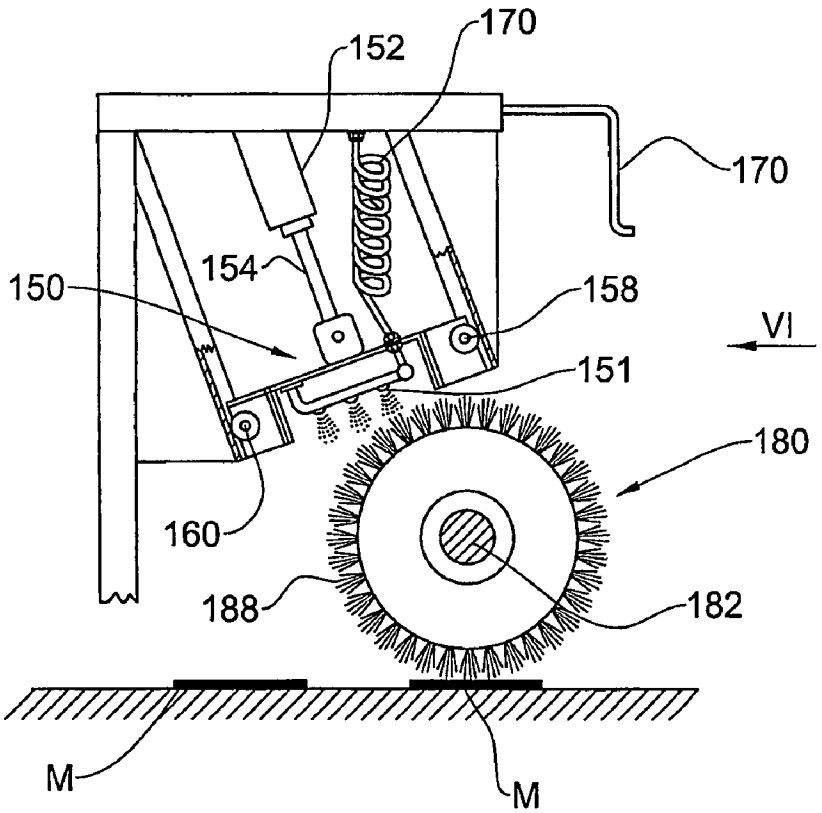
FIG. 5 is a schematic side view of another embodiment of the apparatus according to the present invention.

However, the heating of the road markings M may be indirect, for example by means depicted in FIGS. 5 and 6 (where reference numerals similar to those of FIGS. 1–4 have been used but with the numeral "1" preceding).

As seen in FIGS. 5 and 6, the location and mode of operation of the brush 180 remains unchanged. However, the heating source 150 with torches 151 now corresponds with the brush 180 such that the heat is applied to the bristles 188 of the brush 180. The torches 151 are preferably at an angle to the bristles 188, as seen in FIG. 5. This has the effect of improving the heat transfer to the bristles 188 as well as avoiding excessive heating of the hub of the brush 180.

Hence, now it is the heated bristles 188 that heat the road markings M and together with rotation of the brush 180 remove the markings. Thus, the only portion of the road R that is significantly heated is that portion contacted by the brush 180—presumably just the road markings M.

The heating source 150 is again displaceable by an arrangement comprising, for example, a pneumatic cylinder 152, a piston 154, and supporting rollers 158 and 160 for adjusting the amount of heat applied to the brush 180. Examples of alternate arrangements for displacing the heating source 50, 150 include a threaded spindle (like spindle 20), a gear mechanism, extending-retracting scissor-like rods, a lever system, and the like.

One example of a modification of the above embodiments includes the use of extra brushes (not shown)—potentially each brush having its own heating source. These brushes may spin in opposite directions to thereby improve removal of the markings removal on uneven roads. In a further option, the brush 80, 180 or brushes just referred to may be rotatable at different rpm, and have bristles 88, 188 of different characteristics, e.g. lengths, thicknesses, materials, etc.

Another example of a modification of the above embodiments includes the use of extra heating sources (not shown); e.g. an arrangement wherein both the road R and brush 80, 180—or brushes—are heated.

Yet another example of a modification of the above embodiments includes the use of an additional heating source, or "branch" of the existing heating source (not shown) disposed at the back side of the brush 80, 180. It may happen that some amount of material composing the road markings M may stick to the brush bristles 88. This added heating source may improve removal of road markings material from the brush 80, 180, if any sticks thereto. In the embodiment where the brush 180 is heated by the heating source 150 (FIGS. 5 and 6), that heating source may be sufficient to maintain the cleanliness of the brush bristles 188.

Furthermore, as the road markings M may be composed of various materials and thicknesses, it may be desirable to have available brushes 80, 180 of different characteristics. This can be accomplished, for example, by having more than one brush type installed in the apparatus 12 adaptable to position the appropriate brush adjacent the road markings M or adapting the brushes to allow quick change-out thereof.

Those skilled in the art to which this invention pertains will readily appreciate that numerous changes, variations and modifications can be effectuated without departing from the true spirit and scope of the invention as defined in and by the appended claims.

The invention claimed is:

1. An apparatus for erasing a road marking on a road lane comprising:

a chassis adapted to travel over said road lane;

a heating source mounted to the chassis; and at least one positively driven rotatable brush mounted to said chassis, said at least one brush having bristles configured to be heated directly by the heating source and contactable with said road marking for applying heat thereto for removing the marking from said road, such that the only portion of the road that is significantly heated is that portion contacted by the bristles.

2. The apparatus of claim 1, wherein the heating source comprises fuel torches.

3. The apparatus of claim 1, wherein the heating source is adjustable to a variety of distances from the bristles of the brush.

4. The apparatus of claim 1, wherein one or more of the at least one brush comprises bristles of varying characteristics.

5. The apparatus of claim 1, wherein the bristles of the brush are contactable with the road marking with a pressure determined by one or more springs associated with the brush.

6. The apparatus of claim 1, wherein the bristles of the brush are contactable with the road marking with a pressure determined by an auxiliary weight associated with the brush.

7. The apparatus of claim 1, wherein the brush is replaceable.

8. The apparatus of claim 1, wherein the apparatus comprises multiple brushes.

9. The apparatus of claim 1, wherein at least one of the brushes comprises bristles having characteristics different than those of the bristles of other brushes.

10. The apparatus of claim 8, wherein there are at least two brushes, at least two of which are caused to spin in opposing directions.

11. The apparatus of claim 8, wherein the apparatus is adapted to cause some or all of the brushes to be in contact, or be removed from contact, with the road marking.

12. A method for erasing a road marking on a road lane comprising:

providing an apparatus comprising a chassis having mounted thereto a heating source and at least one brush with bristles, the brush being rotatable for moving the bristles between a first location adjacent said heating source and a second location spaced from the first location at which the bristles are contactable with the lane;

bringing said apparatus to the road lane;

causing said chassis to travel over said road lane;

applying heat directly to the bristles at said first location; and causing said brush to rotate and to move the heated bristles to contact the road marking thereby removing the marking.

13. A method according to claim 12, further comprising applying heat directly to the road marking in front of the location at which the bristles of the brush heat and contact the road marking.

14. A method according to claim 12, wherein said apparatus comprises more than one brush, each brush having its own heating source.

* * * * *